US005199282A

United States Patent [19]

Wang

[11] Patent Number: 5,199,282

[45] Date of Patent: Apr. 6, 1993

[54] PADLOCK WITH ROTARY ROD SHACKLE ENGAGEMENT

[76] Inventor: Ropin Wang, 5F No. 1 Lane 85 Kawang Fu North Rd., Taipei City, Taiwan

[21] Appl. No.: 799,258

[22] Filed: Nov. 27, 1991

[51] Int. Cl.[5] ..... E05B 67/22

[52] U.S. Cl. ..... 70/38 A; 70/39; 70/53; 70/DIG. 62

[58] Field of Search ..... 70/26, 38 R, 38 A, 38 B, 70/38 C, 39, 53, DIG. 62

[56] References Cited

U.S. PATENT DOCUMENTS

| | | | |
|---|---|---|---|
| 145,864 | 12/1873 | Hall | 70/26 |
| 1,384,590 | 7/1921 | Bottone | 70/39 |
| 1,487,258 | 3/1924 | Menger et al. | 70/38 C |
| 1,598,551 | 8/1926 | Brauning | 70/DIG. 62 X |
| 4,064,716 | 12/1977 | Shwayder et al. | 70/39 X |
| 4,085,600 | 4/1978 | Bindari | 70/39 |

FOREIGN PATENT DOCUMENTS

| | | | |
|---|---|---|---|
| 368004 | 1/1923 | Fed. Rep. of Germany | 70/38 A |
| 388160 | 1/1924 | Fed. Rep. of Germany | 70/38 C |
| 427205 | 3/1926 | Fed. Rep. of Germany | 70/39 |
| 428747 | 5/1926 | Fed. Rep. of Germany | 70/39 |
| 491840 | 2/1930 | Fed. Rep. of Germany | 70/38 C |

*Primary Examiner*—Lloyd A. Gall
*Attorney, Agent, or Firm*—Browdy and Neimark

[57] ABSTRACT

An improved padlock comprises a lock body and a shackle. The lock body is provided with a tubular bushing containing a rotating rod capable of being actuated by a lock core. The shackle comprises two insertion ends having retaining grooves. As shackle is inserted into the lock body, the retaining grooves engage securely the rotating rod of the lock body to complete the locking process. The unlocking process is accomplished by actuating the rotating rod to disengage the retaining grooves of the shackle.

3 Claims, 2 Drawing Sheets

PADLOCK WITH ROTARY ROD SHACKLE ENGAGEMENT

BACKGROUND OF THE INVENTION

The present invention relates to a padlock, and more particularly to an improved padlock provided with a rotating rod having a flat tangent segment which can be actuated by a lock core so as to engage or disengage a lock slot having a shape similar to the letter omega of the Greek alphabet located at the entry portion of the circular bolt body. Therefore, the locking and the unlocking of the padlock of the present invention are easily accomplished.

The conventional padlocks for use in motor cycle and bicycle are shown in FIGS. 1 and 2. The padlock shown in FIG. 1 comprises a U-shaped shackle which is pivotally coupled at one end thereof with a lock core having a round hole. A bowlike curved slot and a receiving slot are disposed by the sides of the round hole. The receiving slot is to accommodate therein a round columnar lock body, which can be moved to the edge of the round hole to be connected pivotally with the bowlike curved slot. The lock guide block comprises at inner edge thereof a tangent columnar body for a positioning lock core body to be connected pivotally. The positioning lock core body is provided with an actuating lock core body, which in turn is composed of a positioning plate and an arm plate extending to the bowlike curved slot of the lock guide block in such a way that it can rotate to join with the columnar lock body to carry out the locking and the unlocking mechanisms. The positioning lock core body and the actuating lock body are respectively provided with rows of ball cavities intended to accommodate springs, inner lock balls, and outer lock balls. The positioning plate is composed of a U-shaped connection slot. The actuating lock core body comprises tangent grooves disposed by two sides of ball cavities thereof for the serrated blade of the key to be inserted thereinto. The connection slot is for the flat plate-like portion of the key to be inserted thereinto. As a result, the actuating lock core body can be effectively rotated to open the lock. In addition, the arm plate can be rotated by the actuating lock core body and take part in the locking and unlocking mechanisms along with the columnar lock body. Now referring to FIG. 2, the U-shaped shackle is shown comprising at one end thereof a hook having an appropriate angle and at other end thereof a lock groove. The lock body is provided at one end thereof with a curved slot intended to receive the hook of the shackle and at other end thereof with a lock core and an insertion hole. As a result, when the shackle end having a lock groove is inserted into the insertion hole, the lock core is locked securely by rotating the lock tenon.

The padlocks described above are no doubt capable of carrying out a locking mechanism as expected. However, these two padlocks are generally used to fasten the wheel hub of a motor cycle or a bicycle to prevent it from turning. The users of such padlocks complain of insufficient maneuvering space in which the shackle of the padlock can be inserted into the lock body to complete the locking process.

SUMMARY OF THE INVENTION

It is therefore the primary objective of the present invention to provide a padlock with means which can overcome the shortcoming of the conventional padlock of the prior art.

In keeping with the principles of the present invention, the primary objective of the present invention is accomplished by a padlock, which comprises a lock core located at one end of the lock body and a rotating rod. The lock core is designed to actuate the rotating rod consisting of flat tangent segments positioned correspondingly to the shackle insertion holes in which there are locking grooves intended to retain the flat tangent segments of the rotating rod at the time when the shackle is inserted into the insertion holes of the lock body so as to swivel the rotating rod to complete the locking process. During such locking process, it is not necessary for the user to turn the inserted shackle for any specific angle. In addition, the locking devices, such as flat tangent segments and the locking grooves, of the present invention are disposed on the rotating rod and the shackle and are therefore light in weight and structurally strong to sustain any pulling force up to 3000 kg or more.

The foregoing structures, functions, and features of the present invention will be better understood by studying the following detailed description of the preferred embodiment in conjunction with the drawings provided herewith.

BRIEF DESCRIPTION OF THE DRAWINGS

FIG. 4 includes schematic views showing a flat tangent segment and locking groove at work, in which FIG. 4A shows that the flat tangent segment and the locking groove have not yet engaged, FIG. 4B shows that the flat tangent segment of the rotating rod has been inserted into the locking groove without being rotated, and FIG. 4C shows that the inserted rotating rod has been rotated to complete the locking process.

DETAILED DESCRIPTION OF THE PREFERRED EMBODIMENT

Figure 3:
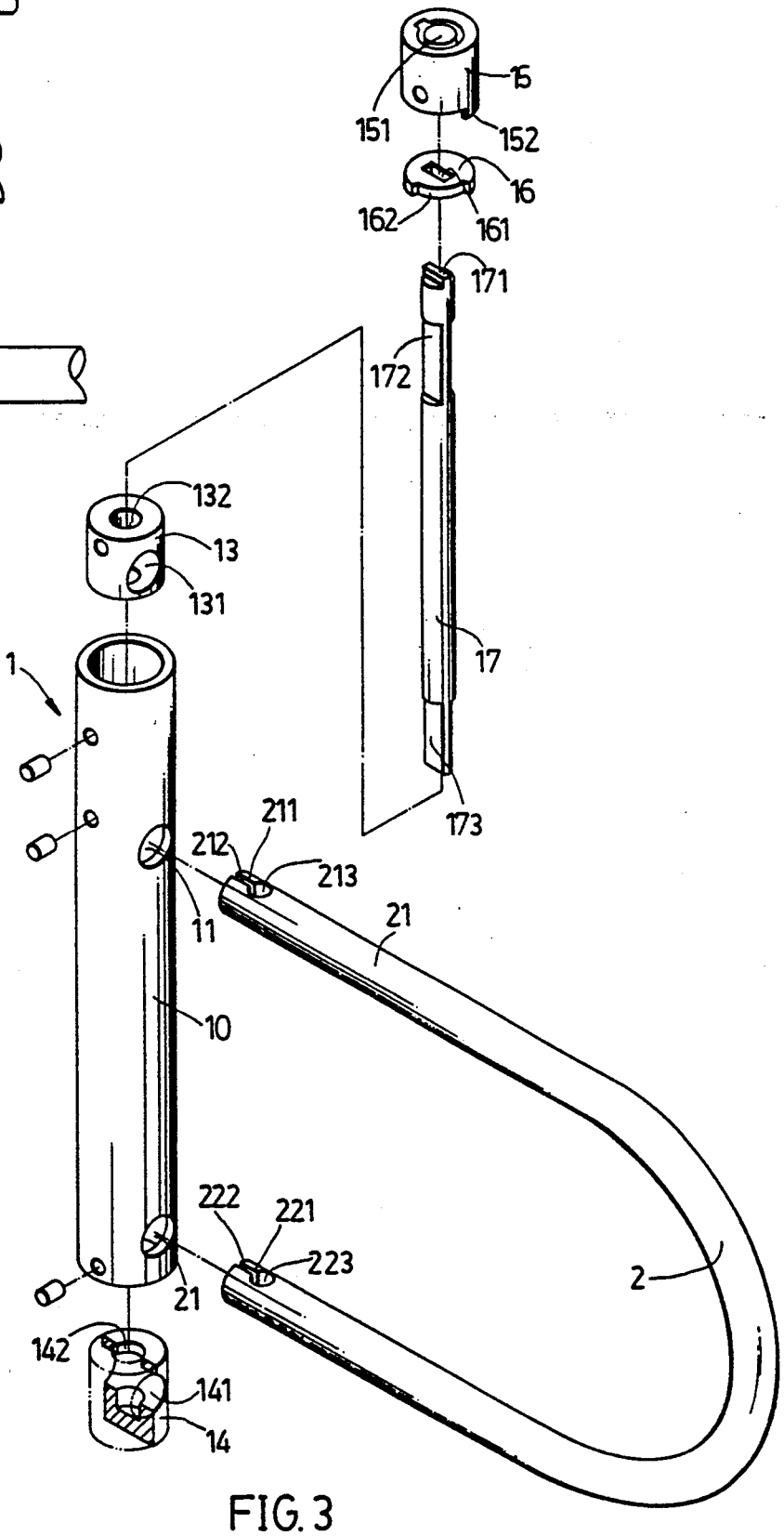
FIG. 3 shows an exploded view of the padlock embodied in the present invention.

Referring to FIG. 3, the padlock embodied in the present invention is shown comprising a lock body 1 and a shackle 2. The lock body 1 is provided with a hollow tubular bushing 10 having two insertion holes 11 and 21 disposed at both ends thereof. Located correspondingly to the insertion holes 11 and 21 are terminal columnar bodies 13 and 14, which are respectively provided with two radially-oriented connection holes 131 and 141 and with centrally-located through holes 132 and 142 intended to permit the rotating rod 17 to rotate in bushing 10. A lock core 15 is disposed at one end of the tubular bushing 10. A rotary key 151 of the lock core 15 engages a riveting hole 161 of the rotary block 16. Rotary block 16 has an indentation 162 with a specific angular extent slidably engaged by projected key 152 so as to confine the rotating angle of the rotary block 16 to about 90 degrees. The rotating rod 17 is provided with a connection key 171 engaging the riveting hole 161 of the rotary block 16 and with flat segments 172 and 173 positioned correspondingly to connection holes 131 and 141 of the terminal columnar bodies 13 and 14. The shackle 2 is provided with insertion ends having respectively the retaining grooves 211 and 221 shown in FIG. 3 which have a shape similar to the letter omega of the Greek alphabet. The open ends 212 and 222 of insertion ends are designed in such a way that they allow the flat segments 172 and 173 to pass therethrough, while the wide portions 213 and 223 of insertion ends have a diameter greater than that of the rotating rod 17 so that the rotating rod 17 can rotate at the wide portions 213 and 223, not at the open ends 212 and 222.

Figure 1:
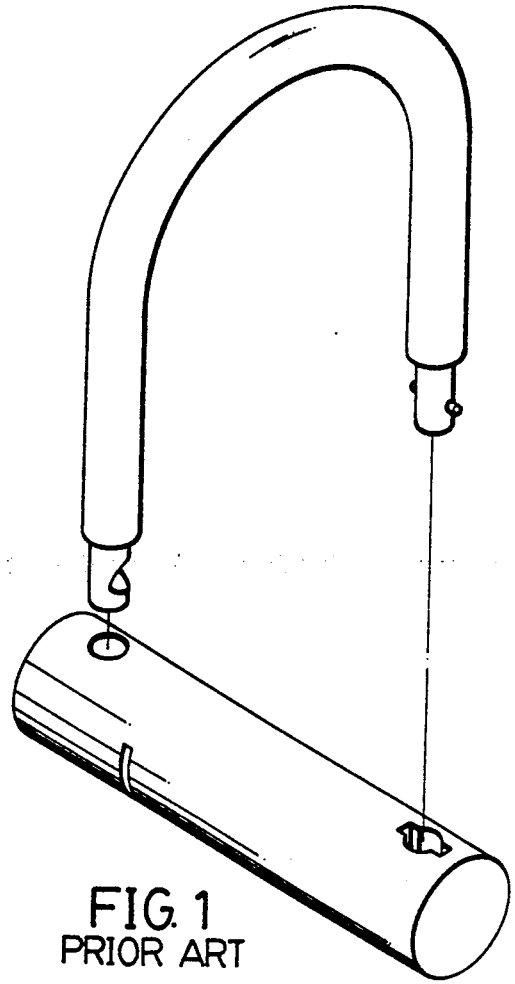
FIG. 1 PRIOR ART
FIG. 1 shows a two-dimensional schematic view of a conventional padlock of the prior art.
Figure 2:
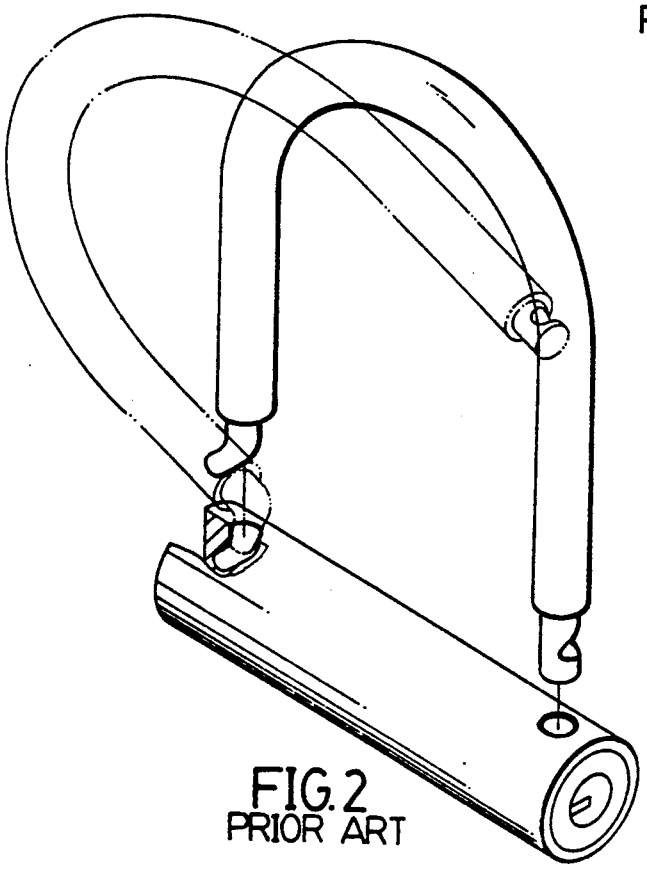
FIG. 2 PRIOR ART
FIG. 2 shows a two-dimensional schematic view of another conventional padlock of the prior art.
Figure 4:
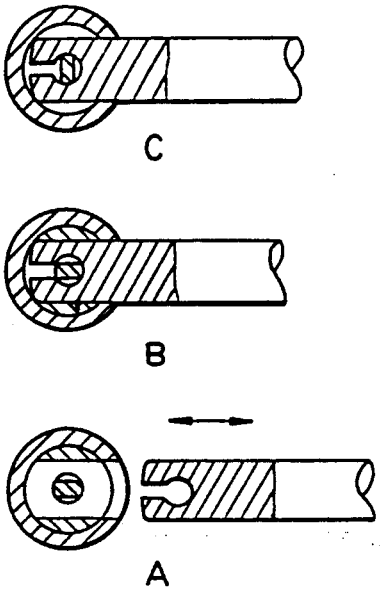

As the lock core 15 actuates the rotating rod 17 to turn so as to permit the flat planes of the flat segments 172 and 173 to face toward the insertion holes 11 and 21 of the lock body 1, the insertion ends of the shackle 2 can be inserted into or pulled out of the insertion holes 11 and 21, as shown in FIG. 4. In the meantime, the flat segments 172 and 173 of the rotating rod 17 can pass through the narrow open ends 212 and 222 of retaining grooves 211 and 221 and then into the wide portions 213 and 223. As a result, the rotating rod 17 can be rotated to permit its flat segments to face the retaining grooves 211 and 221, as shown in FIG. 4C. The rotating rod 17 is then locked into the retaining grooves 211 and 221 so that the shackle 2 is locked securely inside the lock body 1.

It has become apparent that the shackle 2 of the present invention can be easily and directly inserted into the lock body 1 without the shackle 2 being tugged to a specific angle and is therefore better than the prior art padlock. In addition, the locking mechanism of the padlock of the present invention is accomplished by means of a rotating rod, which engages securely the end portions of the shackle. Such locking mechanism is relatively precise and reliable and is less vulnerable to break-up caused by a violent pulling force.

What I claim is:

1. An improved padlock comprising a lock body and a shackle, said lock body having a hollow cylindrical bushing, a first circular insertion hole located near a first end of said hollow cylindrical bushing, a second circular insertion hole located near a second end of said hollow cylindrical bushing, a first terminal body fixedly engaged at said first end of said hollow cylindrical bushing, said first terminal body having a first radial connection hole corresponding to said first circular insertion hole and a circular seating hole communicating with said first radial connection hole facing inward from said first end, of said hollow cylindrical bushing, said circular seating hole being coaxial with an axis of said hollow cylindrical bushing, a second terminal body fixedly engaged inwardly from said second end of said hollow cylindrical bushing, said second terminal body having a second radial connection hole corresponding to said second circular insertion hole and a circular through hole communicating with said second radial connection hole, said circular through hole being coaxial with said axis of said bushing and having a diameter equal to said circular seating hole, a circular rod having a diameter equal to said diameters of said seating hole and said through hole and having two notched segments on sides of said circular rod, each of said two notched segments having two walls parallel to each other and an axis of said circular rod, said circular rod rotably engaged in said seating hole and said through hole so that said two notched segments are respectively located opposite said first circular insertion hole and said second circular insertion hole, said shackle having a pair of insertion ends respectively corresponding to said first circular insertion hole and said second circular insertion hole, each of said pair of insertion ends having a slot and a communicating circular locking hole at an inner end of said slot, each slot having a width substantially equal to a distance between said two walls of said each of said two notched segments, each said communicating locking hole having a diameter substantially equal to the diameter of said circular rod, wherein, said insertion ends of said shackle are insertable through said first circular insertion hole and said second circular insertion hole and over said two notched segments when said circular rod is rotated to an open position of said padlock and a circumference of said circular rod engages walls of each said communicating locking hole when said circular rod is rotated to a closed position of said padlock.

2. The improved padlock according to claim 1, further comprising lock and rotating means engaged to an end of said circular rod at said second end of said hollow cylindrical bushing for rotating said circular rod between said open position and said closed position.

3. The improved padlock according to claim 2, wherein said lock and rotating means comprises a lock core having a rotary key, said rotary key engaged to a riveting hole of a rotary block engaged to said end of said circular rod, said rotary block having an indentation with a predetermined angular extent which confines the rotating angle of said rotary block with respect to said lock core when turned by said rotary key.

* * * * *